United States Patent [19]

Okuda

[11] 4,241,900

[45] Dec. 30, 1980

[54] QUICK ACTING HYDRAULIC LIFTING JACK

[76] Inventor: Genzaburo Okuda, 263-banchi Tanjo Mihara-cho, Minamikawachi-gun, Osaka-Pref., Japan

[21] Appl. No.: 69,507

[22] Filed: Aug. 24, 1979

[51] Int. Cl.[3] ..... B66F 3/24

[52] U.S. Cl. ..... 254/8 B

[58] Field of Search ..... 254/8 R, 8 B, 8 C, 2 R, 254/2 B, 2 C, 124, 93 R

[56] References Cited

U.S. PATENT DOCUMENTS

| | | | |
|---|---|---|---|
| 3,907,252 | 9/1975 | Gaarder | 254/8 B |
| 3,967,814 | 7/1976 | Leibundgut | 254/8 B |
| 4,131,263 | 12/1978 | John | 254/8 B |

*Primary Examiner*—Robert C. Watson

*Attorney, Agent, or Firm*—Fisher, Christen & Sabol

[57] ABSTRACT

A portable hydraulic floor jack has a swinging lift arm actuated by a hydraulic piston which is fed by a pump operated by the tiltable handle of the jack; the handle also having a camming arrangement which will move the lift arm initially into engagement with the load by a single downward movement of the handle.

5 Claims, 4 Drawing Figures

QUICK ACTING HYDRAULIC LIFTING JACK

BACKGROUND OF THE INVENTION

The present invention relates to the type of jack used in service stations and auto repair shops for raising the wheel of an automobile to repair, or change a tire. These jacks have a self-leveling saddle at the end of an arm pivotally mounted at the rear end of a wheeled frame. The frame is also provided with a handle at the rear end of the frame used to guide the jack to place it in position and also to operate the pump which supplies the hydraulic lifting cylinder. Hydraulic lifting devices having individual features which may be pertinent to this invention are disclosed in the following U.S. Pat. Nos.: 2,789,788; 3,404,868; 3,648,856; 3,664,635; 3,807,694; 3,844,534; 3,907,252 and 4,131,263.

BRIEF DESCRIPTION OF THE INVENTION

An object of this invention is to provide a hydraulic lifting jack of the pivoted arm type in which the expanding piston-and-cylinder mechanism is pivotally mounted within the front end of the jack frame and pivotally connected with the lifting arm near is pivotal mounting at the rear of the frame. This arrangement decreases the overall length of the jack as compared to the previous arrangement wherein the pivotal connection with the frame for the piston is closer to the lifting arm connection. This improvement does not reduce the height to which the lifting arm can be raised.

Another object of the invention is to provide a jack having a piston-and-cylinder arrangement in which an oil reservoir is in close proximity to the cylinder and a passage connects the reservoir with the cylinder at a point which represents the maximum travel of the piston in the lifting direction. In comparison with former arrangements in which the piston is provided with an enlarged head to prevent it from being forced out of the cylinder, in the present construction the passage diverts the pumped oil into the reservoir so that no further movement of the piston takes place.

A further object of this invention is to provide a hydraulic floor jack having a handle extending out from the rear of the frame and attached to the lifting cylinder in such a way that by rocking the handle on the rear cross piece of the frame the lifting arm can be raised to bring the saddle up from its lowered position into contact with the load in a single movement of the handle without requiring repeated strikes to pump oil into the lifting cylinder.

Other objects and advantages will be apparent to those skilled in the art after reading the following description in connection with the annexed drawings.

DETAILED DESCRIPTION OF THE INVENTION

Figure 1:
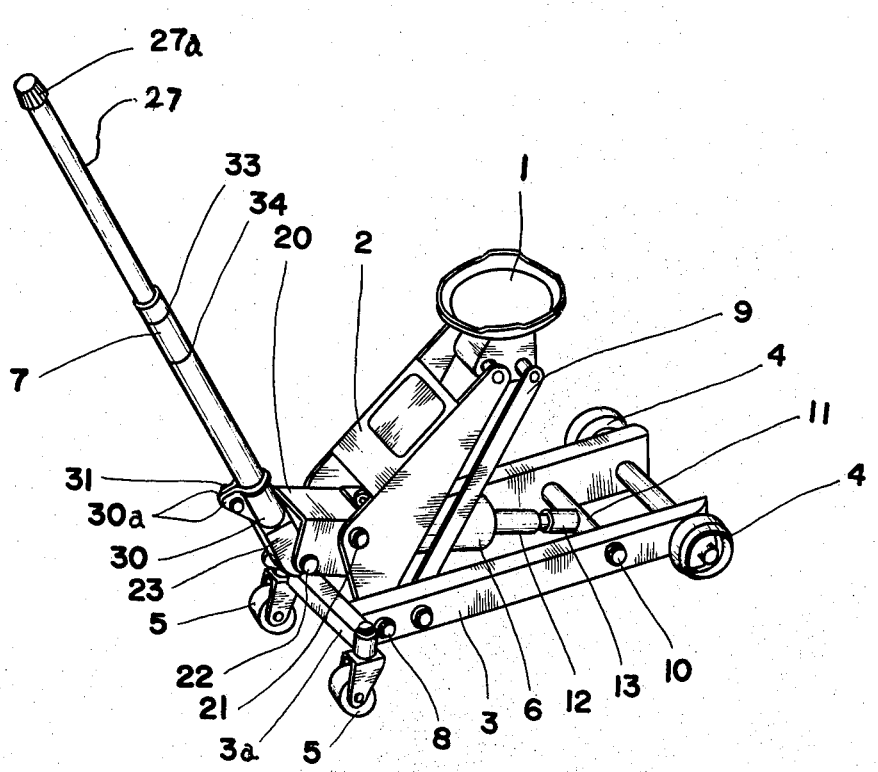
FIG. 1 is a perspective view of a preferred form of lifting a jack according to the present invention.

In the drawings, numeral 1 indicates a saddle which is brought into contact with the bottom of a load to be lifted, such as the frame or axle of an automobile. The saddle is pivotally connected to the extremity of a lifting arm 2. Numeral 3 indicates a generally rectangular frame having a pair of fixed axle front wheels 4 and a pair of swivelling caster wheels 5 at the rear to allow for guiding the jack frame in various directions. Numeral 6 designates a lifting cylinder and numeral 7 designates a handle for operating the cylinder and guiding the frame 3. The lifting arm 2 is supported at its lower end by a pair of pins 8 mounted in the side members of the frame. In addition, stabilizing arms are pivotally connected between the side members of the frame and the saddle 1 parallel with the long axis of lifting arm 2 for keeping the saddle in horizontal position regardless of the position of the lifting arm.

A tubular member 11 is pivotally supported upon a shaft 10 which extends between the side members near the front of frame 3, and a rod-like piston 12 has one end extending into the interior of cylinder 6 with its other end supported by the socket 13 on the exterior of tubular member 11. A transverse member 14, provided with interior oil passages, closes the open end of cylinder 6 and also forms one end of an annular oil supply reservoir 15 which surrounds cylinder 6. The inner end of piston 12 is provided with an L-shaped oil passage, one end of which opens on the interior face of the piston for communication with the interior of cylinder 6, while the other end opens at the side of the piston for communication with a bypass opening 17 in the wall of the bore which supports the piston, when the piston is at its most projected position in the bore, so that any further pumping of oil into cylinder 6 at this point, merely causes it to flow through L-shaped passage 16, and bypass 17 into the reservoir 15 without pushing the piston any further.

The transverse closure member 14 also supports a small reciprocating oil pump 18 and a pressure release valve 19, these devices being protected by a cover 20 supported by closure 14 and extending in a direction away from reservoir 15, whereby the lifting arm 2, which straddles cover 20 can be pivotally connected to it by means of pin 21, located at a short distance from the lower mountings 8 for the arm. A holder 23 for the lower end of handle 7 is also pivotally attached to the open end of cover 20 by means of pin 22, while the lower end of the holder 23 supports a pump operating roller 24 below the pivot 22. The roller 24 is arranged for operational contact with the enlarged head of the projecting end of piston 25 of pump 18 while coil spring 26 exerts force on the head of the piston to maintain contact with roller 24. At the upper end of handle 7 there is a rotatable upper section 27 which is connected, by means which will be explained later, to a socket having a shaft 28 projecting downwardly from the bottom of the handle 7 which is connected by a double universal jointed member 29 to rotate the pressure release valve 19 when section 27 is rotated.

Figure 2:
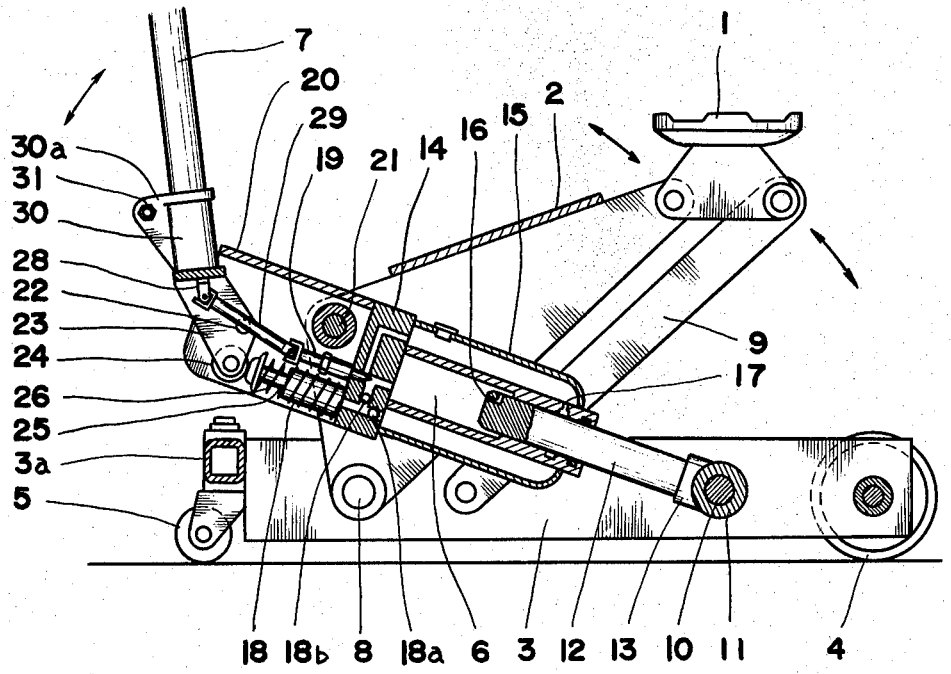
FIG. 2 is a cross-sectional elevation of the jack of FIG. 1.

As shown in FIG. 2, the closure member 14 is provided with interior passages which communicate between the interior of cylinder 6, reservoir 15 and both the reciprocating pump 18 and pressure release valve 19. The passage connecting pump 18 includes a one-way valve **18*a* which permits oil to flow only from the reservoir in the pump when the piston 25 is pushed outwardly by spring 26 and another one-way valve 18*b* which permits oil to flow from the passage only into the cylinder 6 when valve 19** is closed.

Figure 3:
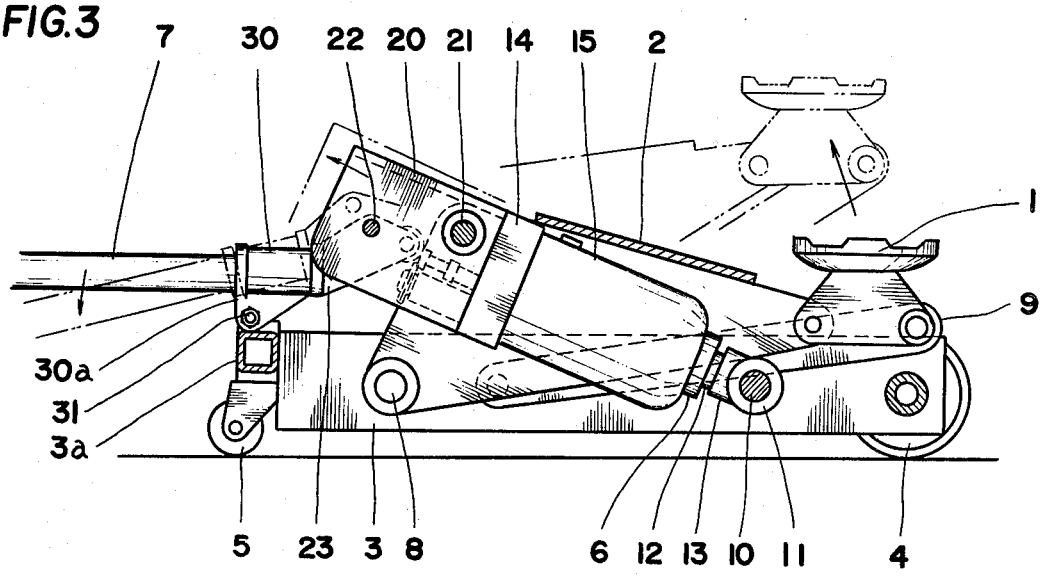
FIG. 3 is a side elevation, with a portion of the frame cut away to illustrate the quick-lifting feature.
Figure 4:
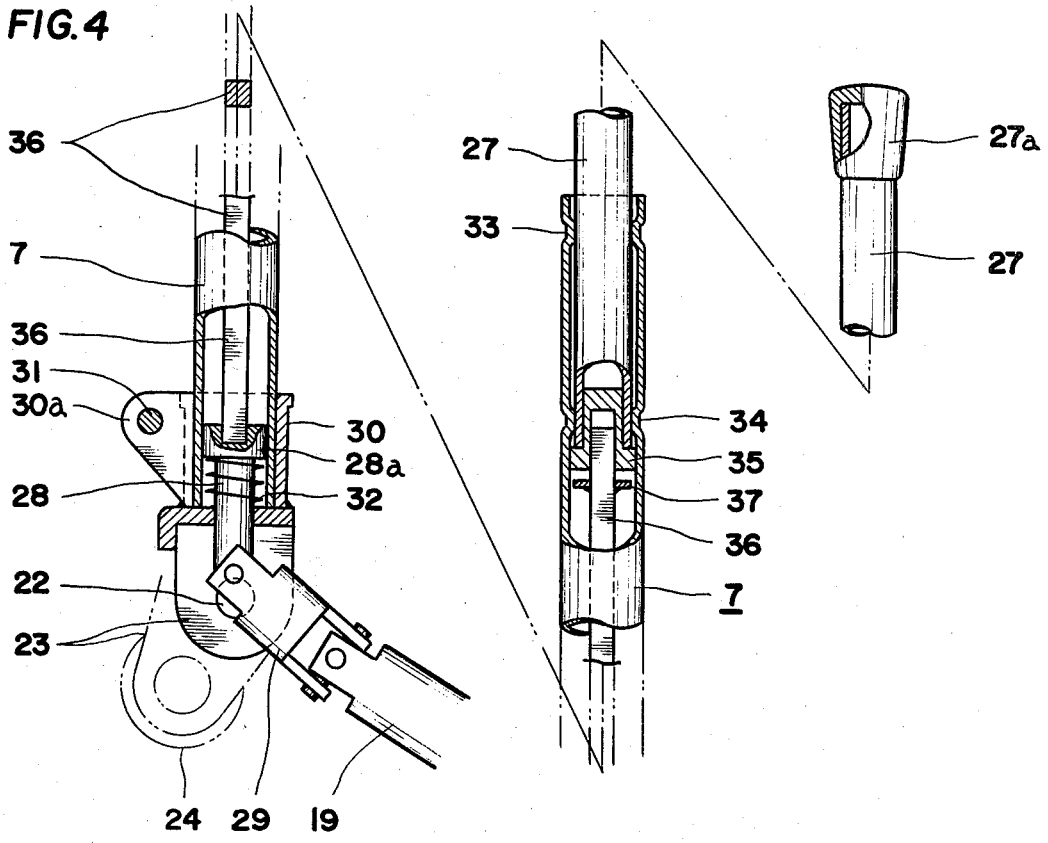
FIG. 4 is a side elevation, partly in section and partly cut away, of the operating handle.

As can be seen in FIGS. 3 and 4, the holder 23 for the handle includes a split collar 30, having rearwardly projecting tapered flanges 30*a* provided with aligned openings to receive a bolt 31 which can be drawn up to compress the flanges 30*a* to clamp the lower end of handle 7 in place in holder 23. Thus, as shown in solid lines in FIG. 3, when the saddle 1 and lifting arm 2 are in their lowered positions, the flanges 30*a* will come in contact with the top of the rear cross member 3*a* of the jack frame as handle 7 is lowered.

Thereafter, upon further downward movement of handle 7, the resultant effect of the sliding movement of the tapered flanges 30*a* on the cross member 3*a* is to pull the cover 20 to the left through the pivotal connection 22 between it and the holder 30, to urge counterclockwise rotation of lifting arm 2 because of the pivotal connection 21 between it and cover 20. At the same time since movement in this direction requires withdrawal of piston 12 from cylinder 6, the arrangement of the one-way valves 18*a* and 18*b* is such that a free flow of hydraulic fluid from reservoir 15 into cylinder 6 is permitted, and for this reason further downward movement of handle 7 will raise the saddle 1 and lifting arm 2 upwardly until it comes into contact with the load, as shown by the dotted lines in FIG. 3. At this point, further lifting is accomplished by returning the handle 7 to a generally upright position where roller 24 contacts the head 25 of pump 18 and pump operation takes place by short up and down movements of handle 7.

Turning now to FIG. 4, it can be seen that shaft 28 projects downwardly from a socket 28*a* slidably contained within the lower end of handle 7, this socket being urged in an upward direction by spring 32.

The tubular upper section 27, provided with a knob 27*a* is inserted into the upper end of handle 7 and rotatably supported therein by a pair of spaced annular constrictions 33 and 34. A flanged socket 35 is fitted into the lower end of section 27 to prevent upward movement beyond the constriction 34.

A shaft 36, having square cross-sectioned ends extends within handle 7 between the upper and lower sockets 35 and 28*a*, each of these sockets being provided with square shaped recesses for the ends of the shaft 36 and the upper end of the shaft may be provided with a flange 37 which presses against socket 35 under the influence of spring 32. In this manner the shaft 36 provides a connection with the universal joint 29 so that rotation of the upper handle section 27 will rotate valve 19 between an open and closed position.

Normally, the handle 7 is maintained in a generally upright position as a result of force exerted by spring 26 urging head 25 against roller 24 (see FIG. 2). In this position, the handle 7 is rocked back and forth to reciprocate the piston of pump 18; each time the piston is depressed oil is conveyed from the cylinder through the passage in closure 14 and check valve 18*b* into cylinder 6 and on the return stroke the spring 26 pushes the piston out to withdraw oil through check valve 18*a* from reservoir 15. As oil is forced into the cylinder there is relative movement of the entire assembly, including cover 20 away from piston 12, connected by shaft 10 to the frame, and this causes the lifting arm 2 to raise the load carried by saddle 1 until a point is reached where the passage 16 in the piston comes into registry with the bypass opening 17. At this point the continued operation of pump 18 merely forces the oil back into the reservoir 15 and no further lifting can take place and there is no chance of the piston being forced completely out of the cylinder.

When it is desired to lower the raised lifting arm the upper section 27 of the handle is rotated to open the pressure relief valve 19 which allows oil to flow back from cylinder 6 into reservoir 15, and the lifting arm 2 and cylinder 6 return to their original positions with the piston 12 fully returned into the cylinder.

In the fully lowered position, as shown in FIG. 3, it can be seen that the assembly including handle 7, cover 20 and reservoir 15 has shifted to the right so that when the handle is brought down to a nearly horizontal position the tapered flanges 30*a* will come in contact with cross member 3*a* of the frame.

As previously described, further downward movement of handle 7 draws the cylinder 6 away from piston 12 as oil flows into the cylinder through one-way valves 18*a* and 18*b* and the lifting arm 2 and saddle 1 are quickly raised into contact with the load without a successive of movements by the handle 7. At this point, or before the initial raising of the saddle 1 is performed, the valve 19 should close by rotating upper handle 27, to ensure that the lifting arm 2 does not return to the lowered position.

When the jack is to be stored, or packaged for shipment, the handle 7 can be disassembled by first loosening the bolt 31 and removing knob 27*a* from the upper end of upper handle section 27. This allows handle 7 to be removed from the split collar 30 and the lower end of square shaft 36 to be removed from the socket 28*a* and its upper end from socket 35, while the upper section 27 can be removed from the lower end of handle 7. To assemble the handle these operations are performed in the reverse order; the upper section 27 is inserted into the lower end of handle 7 and pushed in until the socket 35 contacts the constriction 34, the square is inserted with its upper in the socket 35 and the lower ends of the shaft and handle 7 are inserted into socket 28*a* and collar 30 respectively. Finally, the bolt 31 is tightened to hold the elements in place and knob 27*a* is attached at the upper end of section 27. The lengths of the sections 7 and 27, and the shaft 36 do not exceed the overall length of the jack itself so that all of the parts can be conveniently packed together, and the assembly and disassembly is controlled by dealing only with the bolt 31.

As described above the construction of the jack is such that the saddle 1 is mounted on the lifting arm 2 at the front end of the frame 3, while the rear end of the arm is pivoted at the rear of the frame. Since the outer end of cylinder 6 is pivotally connected to the lifting arm 2 at an intermediate point, and the end of piston rod 12 is attached to the front end of the frame, the length of the frame can be shortened without reducing the lifting capacity of the saddle 1. Also, since the cylinder 6 is supported within the lifting arm 2, the lengths of the frame 3 and the arm can be made approximately the same, maximum lifting capacity of the arm can be maintained and the entire construction can be simple, compact and light in weight.

With the pump 18 for delivering hydraulic fluid to the cylinder 6, the oil reservoir 15 surrounding the cylinder, and the passages 16 and 17 being provided to allow fluid to pass into the reservoir 15 when the piston 12 is fully extended, it is not necessary to provide a special valve to limit movement of piston 12, as was previously necessary. Since this extra valve is eliminated the construction is simplified and is easily assembled. Furthermore, even though the piston 12 is not provided with a separate valve, the passages 16 and 17 prevent it from being pushed out of the cylinder regardless of the amount of pressure is supplied by pump 18 and the piston is more durable.

Finally, the arrangement of the handle 7 at the rear of cylinder 6, so that flanges 30*a* at its base may contact the rear frame member 3 when the handle is lowered, means that the saddle 1 can be initially raised into contact with the load with one stroke of the handle rather than by repeated operation of the pumping mechanism as is the case with known hydraulic jacks.

Other modifications and improvements will be apparent to those skilled in the art which would come within the scope of the annexed claims.

I claim:

1. In a portable hydraulic jack of the type wherein a load supporting arm means is pivotally mounted on wheeled carriage means for swinging movement in a vertical plane, said carriage means including elongated vertically swingable handle means for propelling and guiding the carriage means on a floor and for incrementally raising the arm means by reciprocatory movement in a vertical plane to actuate a hydraulic pump means, the improvement which comprises force transferring means automatically actuated by swinging movement of said handle means in one direction to initially mechanically raise said arm means from a lowered position into contact with a load.

2. A portable hydraulic jack as defined in claim 1, wherein said carriage means includes a frame, said arm means being pivotally connected to said frame, whereby an element of the frame is relatively displaceable with respect to an element of the arm means, said handle means being pivotally connected to one of said elements and having a member engageable with the other of said elements to draw the arm means in an upward direction.

3. A portable hydraulic jack as defined in either one of claims 1 or 2, wherein a piston-and-cylinder means is pivotally connected between said arm means and said frame for elevating said arm means under load, said piston-and-cylinder means including reciprocating plunger pump means and hydraulic fluid reservoir means operatively joined together by valved hydraulic conduit means, said handle means being pivotally mounted on the piston-and-cylinder means and having a member for camming engagement with an element of said frame for initially raising the arm means.

4. A portable hydraulic jack as defined in claim 3, wherein said member is engageable with said frame element only while the handle means is swinging in a generally horizontal position.

5. A portable hydraulic jack as defined in claim 4, wherein said handle means includes a member at one end projecting beyond the pivotal mounting for operative engagement with the plunger pump means only when the handle means is swinging through an upper portion of its arc of movement.

* * * * *

UNITED STATES PATENT OFFICE

CERTIFICATE OF CORRECTION

Patent No. 4,241,900 Dated December 30, 1980

Inventor(s) Okuda

It is certified that error appears in the above-identified patent and that said Letters Patent are hereby corrected as shown below:

On the face of the patent, please enter the following

[30] Foreign Application Priority Data

August 28, 1978 Japan ..... 53-117511

September 13, 1978 Japan ..... 53-126102

Signed and Sealed this

Tenth Day of March 1981

[SEAL]

*Attest:*

RENE D. TEGTMEYER

*Attesting Officer* *Acting Commissioner of Patents and Trademarks*